US008443894B2

(12) United States Patent
Coghill et al.

(10) Patent No.: US 8,443,894 B2
(45) Date of Patent: May 21, 2013

(54) ANCHOR/SHIFTING TOOL WITH SEQUENTIAL SHIFT THEN RELEASE FUNCTIONALITY

(75) Inventors: Anthony S. Coghill, Tulsa, OK (US); Thomas S. Myerley, Broken Arrow, OK (US); Ronald J. Garr, Inola, OK (US)

(73) Assignee: Baker Hughes Incorporated, Houston, TX (US)

( * ) Notice: Subject to any disclaimer, the term of this patent is extended or adjusted under 35 U.S.C. 154(b) by 611 days.

(21) Appl. No.: 12/621,090

(22) Filed: Nov. 18, 2009

(65) Prior Publication Data

US 2011/0114325 A1 May 19, 2011

(51) Int. Cl.
*E21B 34/14* (2006.01)

(52) U.S. Cl.
USPC ..... 166/332.4; 166/332.3

(58) Field of Classification Search
USPC ..... 166/386, 381, 373, 332.2–332.4
See application file for complete search history.

(56) References Cited

U.S. PATENT DOCUMENTS

| | | | | |
|---|---|---|---|---|
| 4,433,726 | A * | 2/1984 | Preston et al. | 166/118 |
| 4,917,191 | A | 4/1990 | Hopmann | |
| 4,928,772 | A | 5/1990 | Hopmann | |
| 4,944,350 | A * | 7/1990 | Airey | 166/373 |
| 5,305,833 | A * | 4/1994 | Collins | 166/386 |
| 5,309,988 | A * | 5/1994 | Shy et al. | 166/72 |
| 5,549,161 | A | 8/1996 | Gomez | |
| 5,636,694 | A | 6/1997 | Mireles, Jr. | |
| 5,678,633 | A | 10/1997 | Constantine, Jr. | |
| 5,765,640 | A | 6/1998 | Milne | |
| 7,556,102 | B2 * | 7/2009 | Gomez | 166/373 |
| 7,562,703 | B2 | 7/2009 | Palmer | |

OTHER PUBLICATIONS

Constantine, Jessie J., "Selective Production of Horizontal Openhole Completions Using ECP and Sliding Sleeve Technology", SPE 55618, May 1999, 1-5.
Myal, F.R., et al., "Slant-Hole Completion Test in the Piceance Basin, Colorado", SPE 21866, Apr. 1991, 611-622.
Buffington, Neil, et al., "New Technology in the Bakken Play Increases the Number of Stages in Packer/Sleeve Completions", SPE 133540, May 2010, 1-17.

* cited by examiner

*Primary Examiner* — William P Neuder
*Assistant Examiner* — Kipp Wallace
(74) *Attorney, Agent, or Firm* — Steve Rosenblatt

(57) ABSTRACT

The tool can run in and latch another tool such as a ball valve into a packer, for example. It has the capability of operating the valve while still engaged to the valve housing. Once the valve is operated and released a pressure test can be conducted while the tool is still engaged to the valve housing. After that a predetermined applied force allows release from the valve housing without the valve shifting mechanism still engaged. In a different configuration the tool can be a simple pulling tool to remove the valve housing without shifting it. The tool has a rotational lock to allow release from a packer by turning to the right. In another configuration it can be a latch tool for a production string that shifts the valve as it releases when the production string is pulled.

22 Claims, 16 Drawing Sheets

ANCHOR/SHIFTING TOOL WITH SEQUENTIAL SHIFT THEN RELEASE FUNCTIONALITY

FIELD OF THE INVENTION

The field of the invention is a tubing conveyed tool that can deliver or retrieve a downhole valve or other tool to subsequently secure or release the valve or other tool at a location downhole. The operation of the valve or other tool occurs discretely and precedes the release of the tubing conveyed tool from the downhole valve or other tool. Other embodiments of the tubing conveyed tool are directly secured to and then released from a previously mounted valve or other tool.

BACKGROUND OF THE INVENTION

In some instances a valve or other tool needs to be installed at a location such as a packer or elsewhere downhole and secured into place by a tubing conveyed tool. The valve or other tool then needs to be actuated to facilitate a downhole operation and ultimately the tubing conveyed tool needs to release and leave the operated valve or other tool at the location. In the case of a valve or other tool with an operating linkage the tools of the past have delivered the valve or other tools to the location downhole but have combined the actuation of the valve or other tool with the release of the tubing conveyed tool. The problem with this arrangement was that in a long string the substantial pulling force that was required to release could be enhanced by the potential energy stored in the string that is being pulled upon at the surface. With the tubing conveyed tool still trying to shift the actuating member in the valve or other tool as it is also trying to release from the valve or other tools housing, a situation may occur where undue dynamic forces could be transmitted to the valve or other tools operator components at the time the release occurs. During release, a sudden translation of the tubing conveyed tool from the valve or other tool could occur and result in undue stresses to the valve or other tools operating assembly as a part of the release function.

Another shortcoming of the prior tool design is that it provided no opportunity to test the valve or other tool to determine if it actually operated and could hold pressure before releasing from it.

One such tool sold in the past was offered by Baker Oil Tools under the name RCV Running and Shifting Tool. Shifting tools are illustrated in U.S. Pat. Nos. 5,636,694; 5,765,640; 7,562,703; 7,556,102; 5,678,633; 5,636,694; 5,549,161; 4,928,772; 4,917,191.

The present invention addresses the need to protect the valve or other tool by operating the valve or other tool first with upward pulling force of the work string while still remaining engaged to the valve or other tool with the tubing conveyed running tool. After the valve or other tool is operated, such as a valve being closed, pressure can optionally be applied through the work string or the surrounding annulus to test if the valve or other tool and for that matter a packer that may be attached to it will hold pressure. Only then will an additional amount of upward pulling force be applied after there has already been an actuation of the shifting mechanism of the valve or other tool so that the tubing conveyed running tool releases and the valve or other tool can be left at the location downhole while the running string is removed. The tool of the present invention can also be configured to pull the valve from the location downhole such as out of a packer while not actuating the shifting mechanism of the valve or other tool to prevent pulling of a wet string. In another configuration it can be used as a latch tool only so as to connect a production string to a location downhole such as in a packer and when needed allow the valve or other tool to be operated and the tool removed with the production string. These and other aspects of the present invention can be more readily understood by a review of the description of the preferred embodiment and the associated drawings while recognizing that the full scope of the invention is to be determined by the appended claims.

SUMMARY OF THE INVENTION

The tool can be utilized to run in and latch another tool such as a ball valve to a location downhole such as to a packer. It has the capability of operating the valve or other tool while still being engaged to its housing. Once the valve or other tool is actuated a pressure test can be conducted while the tool is still engaged to the valve or other tools housing. After that a predetermined applied force allows the tool to release from the valve or other tools housing without the valve or other tools shifting mechanism still being engaged by the tool during the release. In a different configuration the tool can be a pulling tool to retrieve the valve or other tool from the location downhole without shifting it. Either configuration of the tool can have a rotational lock to allow release from a location downhole such as at a packer by turning to the right. In another configuration it can be a latch tool for a production string that shifts the valve or other tool and then releases when the production string is pulled.

DETAILED DESCRIPTION OF THE PREFERRED EMBODIMENT

Figure 1A:
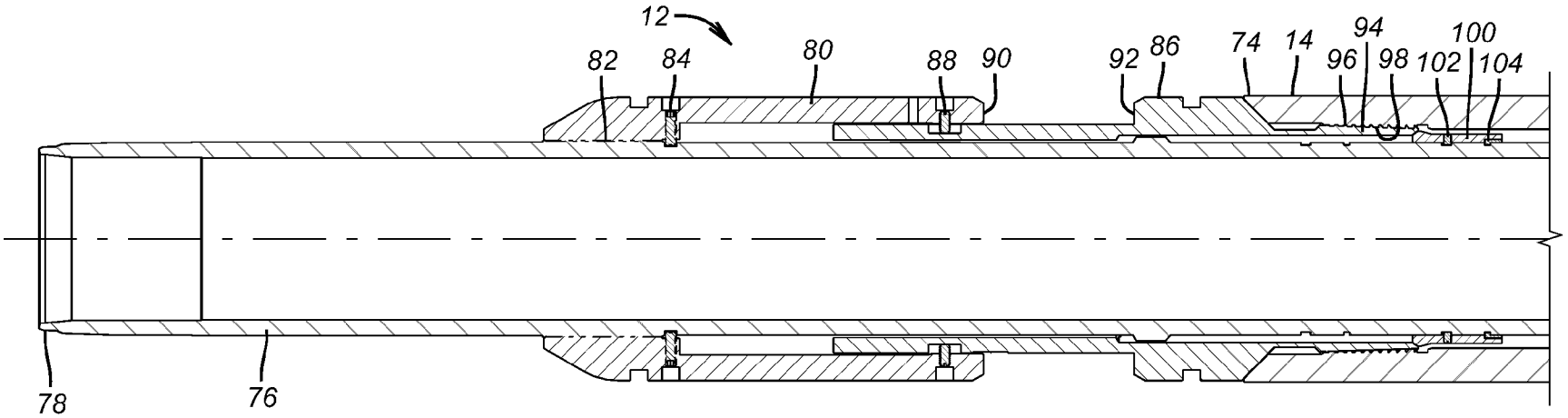
FIGS. 1*a*-*d* is a full section of the fully configured version of the tool in the run in position.

There are two major components illustrated in FIG. 1. The valve 10 which extends from the right side of FIGS. 1*a* and 1*b* to FIGS. 1*c* and 1*d* and the running and pulling tool (RPT) 12 that is above in FIGS. 1*a*-1*b*. The valve 10 will first be described. Housing 14 is a multi-component structure that starts at FIG. 1*a* and continues to a lower end 16 in FIG. 1*d* where it is latched to a schematically illustrated packer 18 with a latch with left hand thread built into it and schematically shown as anchor 20. Alternatively, other latch locations below the valve 10 are contemplated. For clarity the packer 18 and the anchor 20 will only be shown in FIG. 1*d* although it is present in the other views at the lower end of each view. The purpose of the left hand thread as part of anchor 20 is to facilitate release from the packer 18 by rotation to the right if the latch mechanism for some reason does not release when subjected to a pull force of a predetermined value. Typically such an anchor 20 is held by a sleeve or ring that is in turn held by a shear device that is generally set higher than a shear device in the RPT 12 so that when pulling on the RPT 12 the RPT 12 will release from housing 14 of the valve 10 without pulling the anchor 20 out of the packer 18.

Figure 1B:
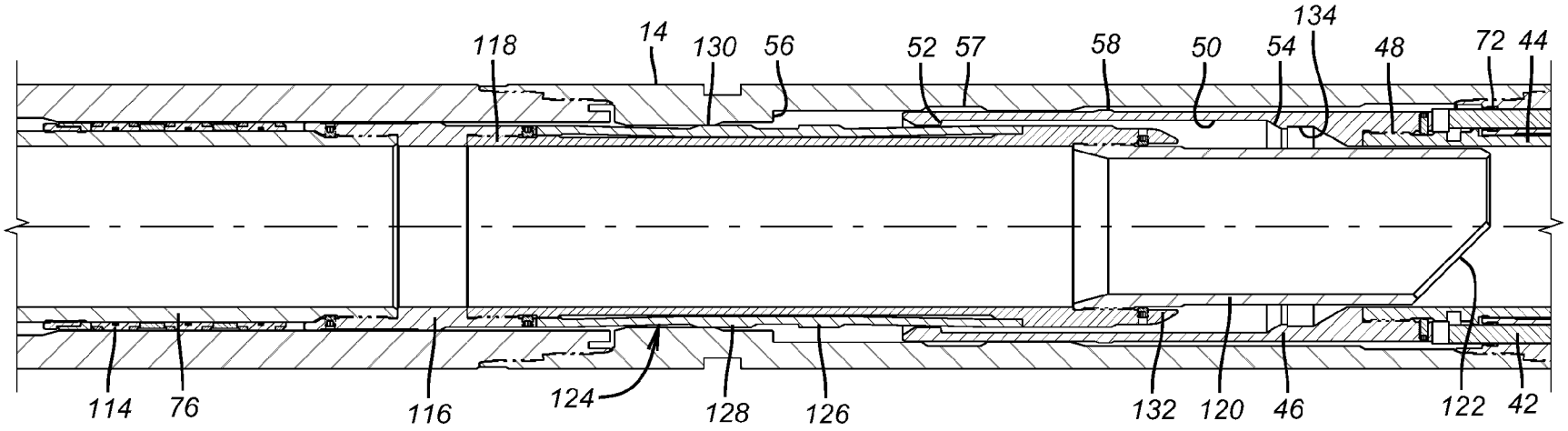
Figure 1C:
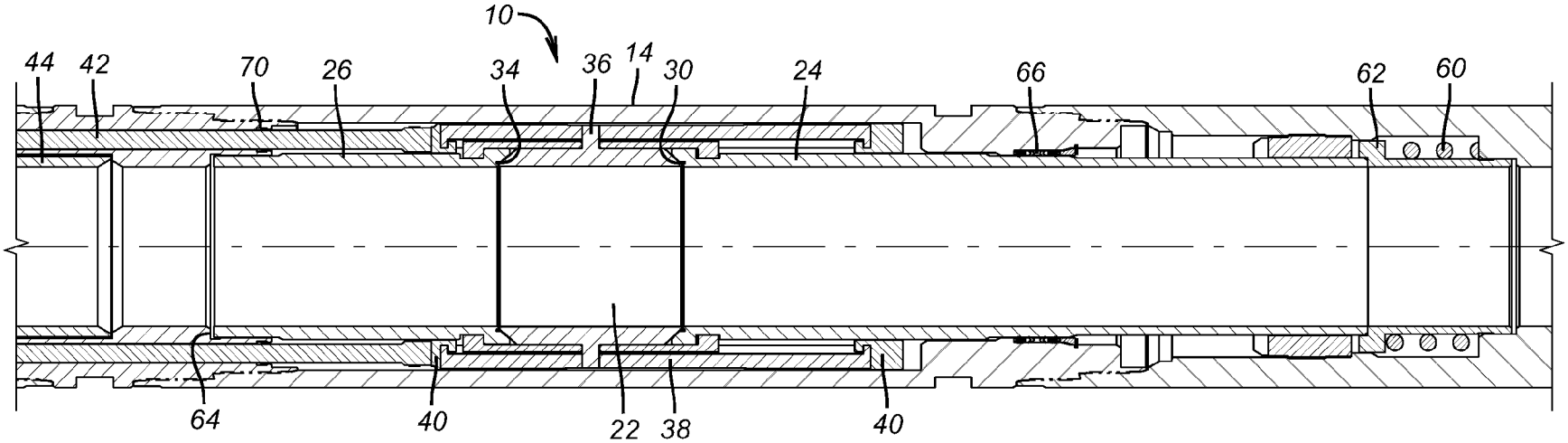
Figure 3B:
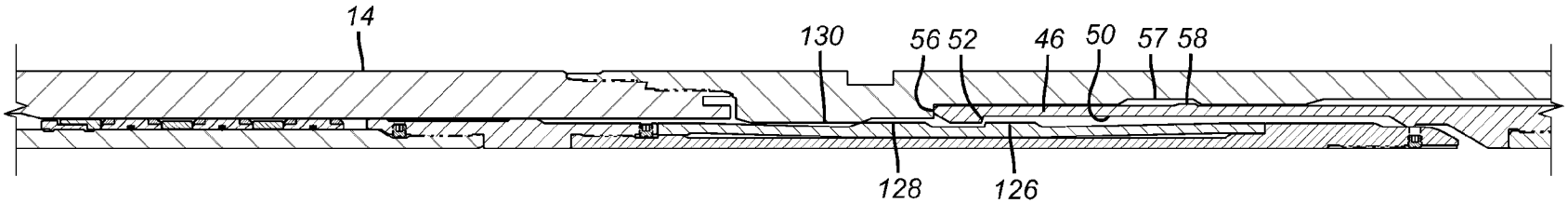
Figure 4B:
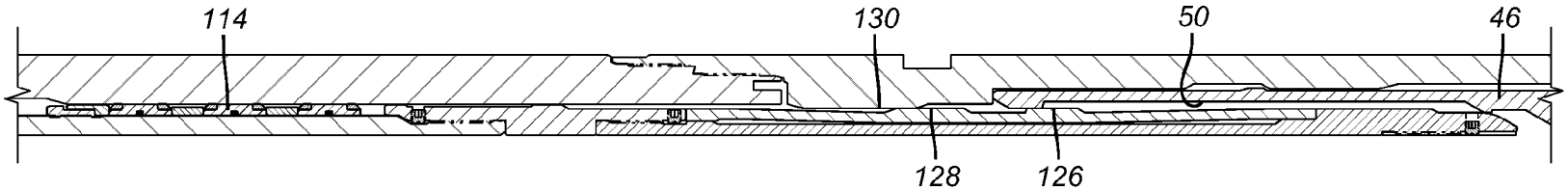
Figure 5B:
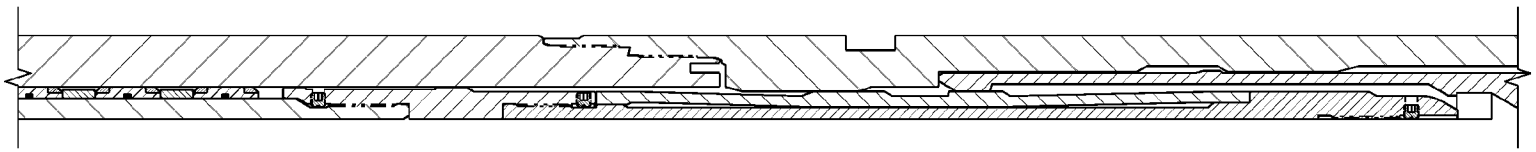
Figure 6B:
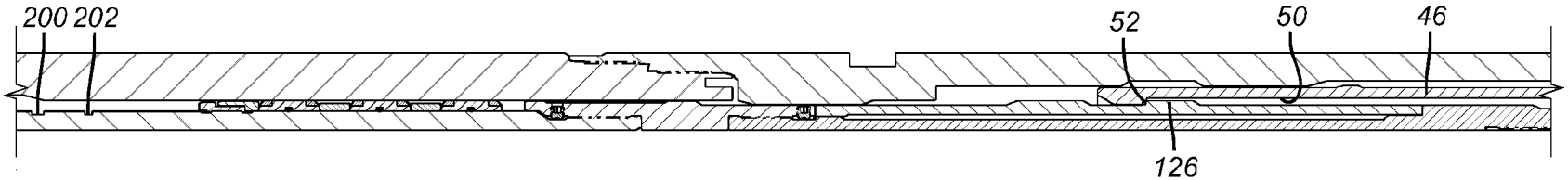
Figure 3C:
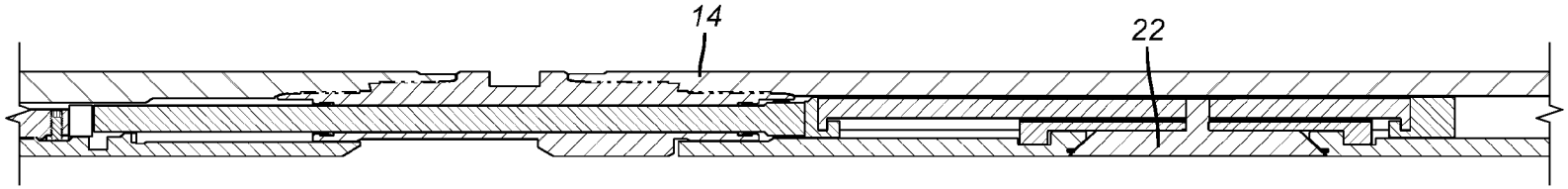
Figure 4C:
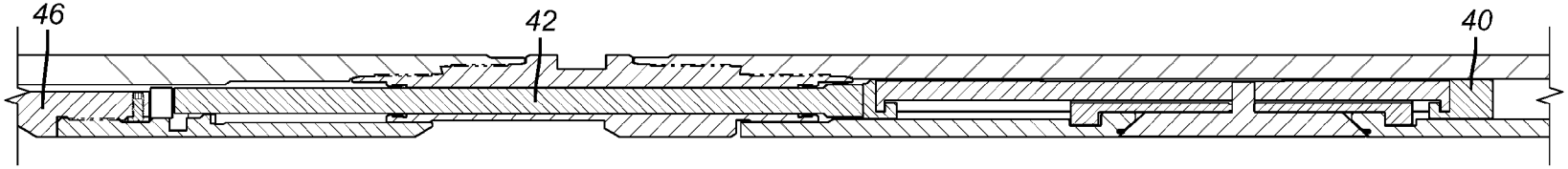
Figure 5C:
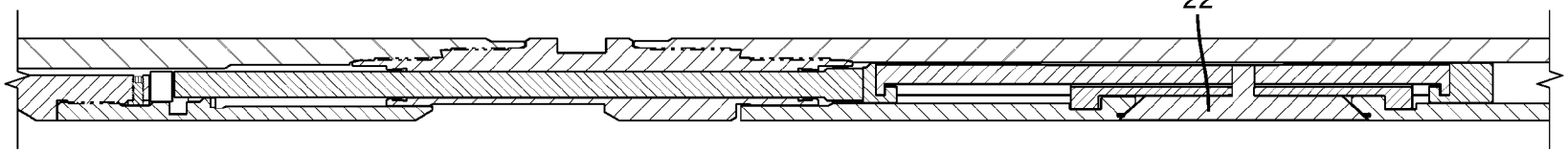
Figure 6C:
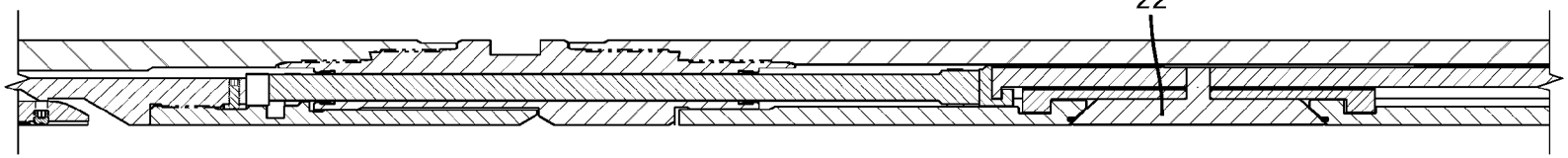
Figure 3D:
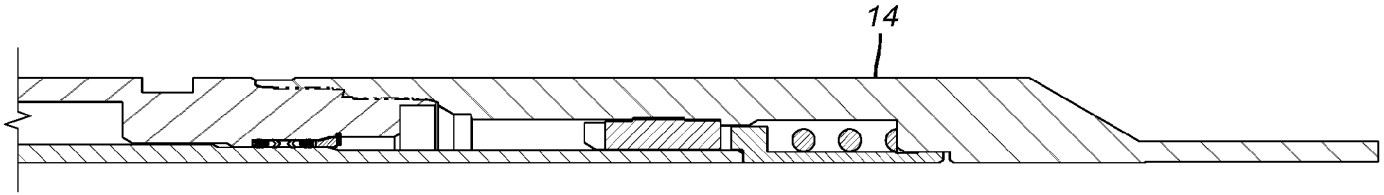
Figure 4D:
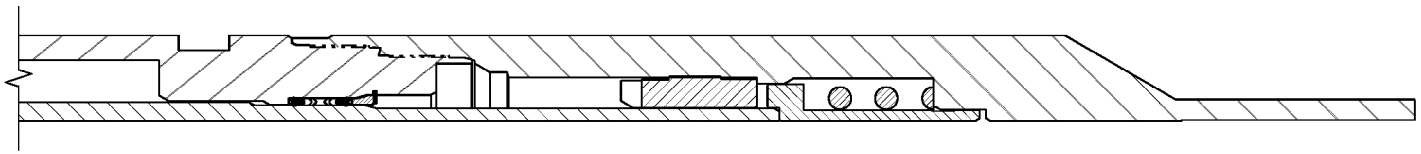
Figure 5D:
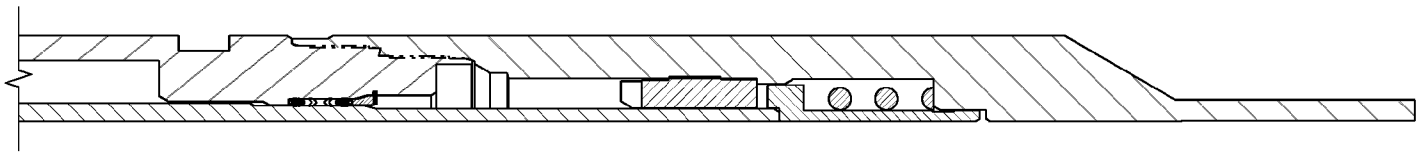
Figure 6D:
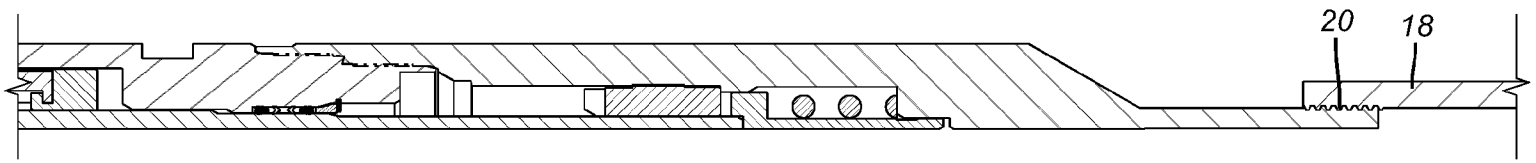

The valve 10 has a ball 22 shown in the open position when the RPT 12 runs it in for latching the anchor 20 to the packer 18. A lower seat sleeve 24 and an upper seat sleeve 26 are disposed on opposed sides of the ball 22. Sleeve 24 has a seal 30 that engages the ball 22 and sleeve 26 has a seal 34 that also engages the ball 22. Ball 22 pivots on central pivot pins 36 located on opposed sides of ball 22 and supported on a frame 38. A slide assembly 40 is nested with frame 38 and has an off center connection to the ball 22 such that when the slide assembly 40 translates with respect to the frame 38 the ball 22 can rotate in opposed directions for 90 degrees to go from the shown open position in FIG. 1*c* to a closed position of FIG. 3*c* and back again as will be explained below. A plurality of connecting rods 42 are secured at a lower end to the slide assembly 40 as shown in FIG. 1*c* and at an upper end to a sleeve assembly 44 as shown in FIG. 1*b*. An actuating sleeve 46 is secured at threads 48 to sleeve 44. Actuating sleeve 46 has a long internal groove 50 with a square shoulder 52 at its upper end and a taper 54 at its lower end. Housing 14 has a travel stop 56 that marks the upward travel limit of the actuating sleeve 46 and illustrated in FIG. 3*b* marking the closed position of the ball 22. An outer shoulder 58 is on the actuating sleeve 46 and is designed to land in groove 57 in the housing 14 when shifted up to close the ball 22, as shown in FIG. 3*b*. Referring back to FIG. 1*c* a spring 60 pushes sleeve 62 against the assembly of sleeve 24, ball 22 and sleeve 26 against a travel stop 64 in the housing 14. Seal 66 isolates pressure in passage 68 from the location of the slide assembly 40. Bushings 70 and 72 facilitate reciprocation of the rods 42 through the housing 14. Optionally sleeve 26 can be sealed to the housing 14 at the outer periphery of sleeve 26. Finally, housing 14 has a top end 74 onto which the RPT 12 lands, as shown in FIG. 1*a*.

Figure 2A:
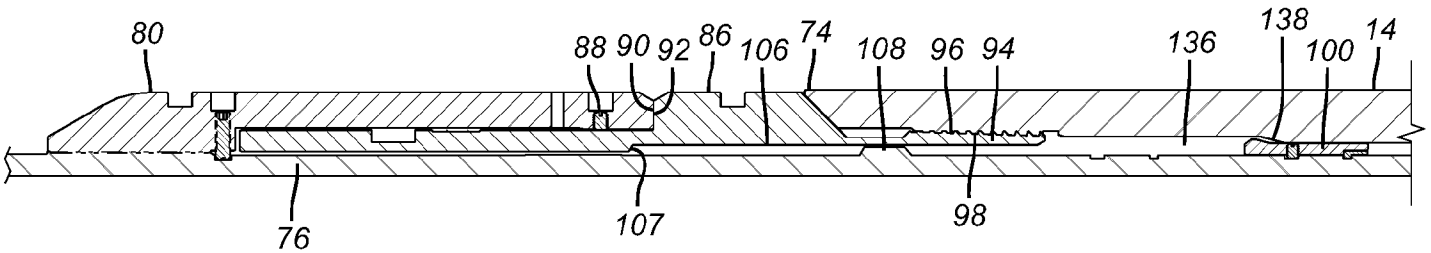
FIGS. 2*a*-2*e* is the tool of FIGS. 1*a*-1*d* in half section showing the set down and shear that latches the tool to the valve actuation sleeve.
Figure 4A:
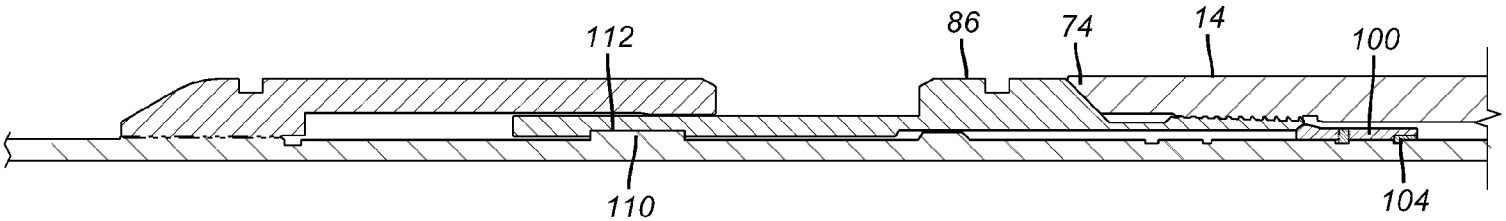
FIGS. 4*a*-4*d* are the view of FIGS. 3*a*-3*d* showing the tool picked up to engage the threaded latch to the top of the valve housing so that a pressure test can be performed on the closed valve followed by a shear release.
Figure 5A:
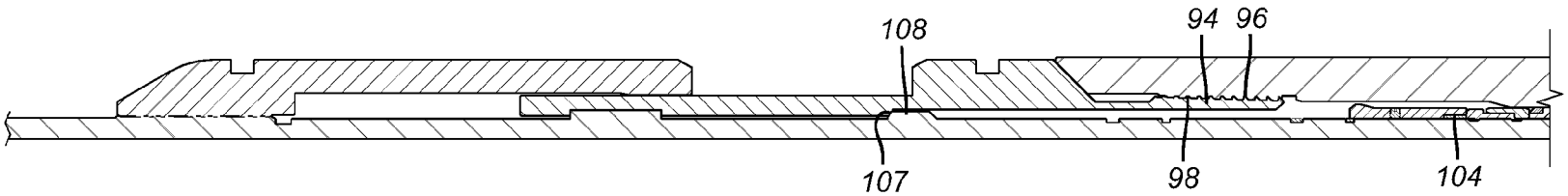
FIGS. 5*a*-5*d* are the view of FIGS. 4*a*-4*d* showing the tool following the shear of the shear release component and then picked up to engage a shoulder of the threaded latch component but momentarily still attached to the valve housing.
Figure 6A:
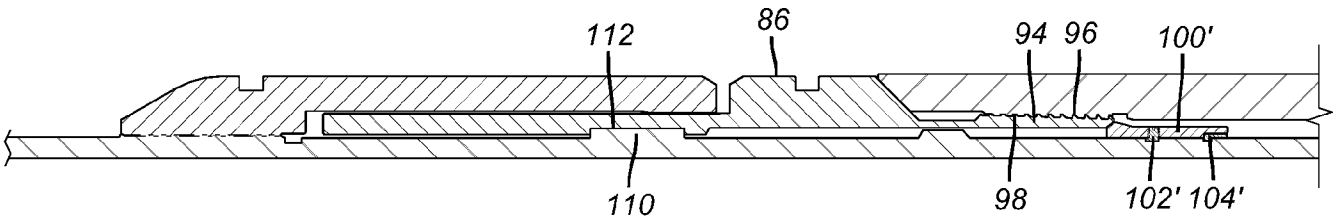
FIGS. 6*a*-6*d* shows an alternate location of the shear ring in the tool of FIGS. 1*a*-1*d* where the valve position will not be shifted as the valve is removed by holding its housing.

The RPT 12 will now be described in more detail. A mandrel 76 is connected at an upper end 78 to a tubular string that is not shown. A latch retainer 80 is secured to mandrel 76 at threads 82 and secured by one or more set screws 84. A latch 86 is secured with a shear screw or screws 88 to the latch retainer 80. Latch Retainer 80 has a travel stop 90 that is engaged by the shoulder 92 of the latch 86 when weight is set down on the mandrel 76 as shown in FIG. 2*a*. The latch 86 has a series of flexible collet fingers 94 that have an external square right hand thread 96 that collapse to latch or thread into threads 98 in housing 14 for run in. A shear block 100 is secured to the mandrel 76 by one or more shear screws 102 and a shear ring 104 that is set to release at a much higher value than the screw or screws 102 as will be explained below. In essence the shear ring 104 is a split ring that needs the shear block 100 to be positioned over it so it will work when needed. The shear screws 102 retain the shear block 100 over the shear ring 104 until a sufficient uphole pulling force is applied to mandrel 76 which will shear both screws 102 and shear ring 104 at the same time. In the assembled position for run in, the shear block 100 is up against or adjacent the collet fingers 94. As better seen in FIG. 2*a* the latch 86 has an internal diameter 106 and an upper shoulder 107 of a smaller diameter against which an external lug 108 on mandrel 76 will ultimately hit when the mandrel 76 is pulled out of the hole as shown in FIG. 5*a*. Referring to FIG. 4*a* the mandrel 76 has a fin or fins 110 that fits into a matching groove or grooves 112 of the latch 86 so that the mandrel 76 is rotationally locked to the latch 86. Having this rotational locking feature allows a turning force to the right on the mandrel 76 to be transmitted through the latch 86 through its collet fingers 94 that are externally threaded at 96 to mating housing 14 threads 98. Since the connection to the packer 18 shown in FIG. 1*d* at anchor 20 is a left hand thread, it is possible if the valve 10 does not release from the packer 18 with a pull force of a predetermined value to still get a release by turning the mandrel to the right to undo the left hand thread of anchor 20 using the rotationally locked feature of the fin or fins 110 in mating groove or grooves 112.

Figure 2B:
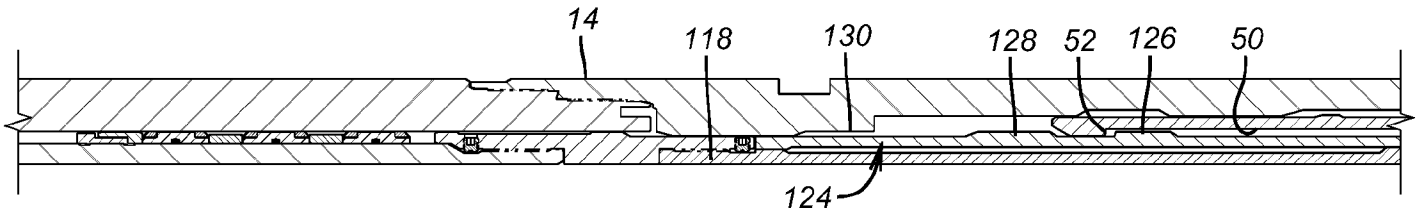
Figure 2C:
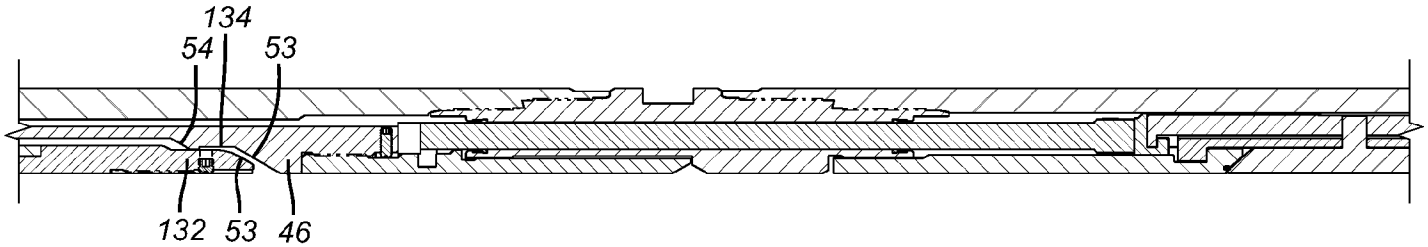
Figure 1D:
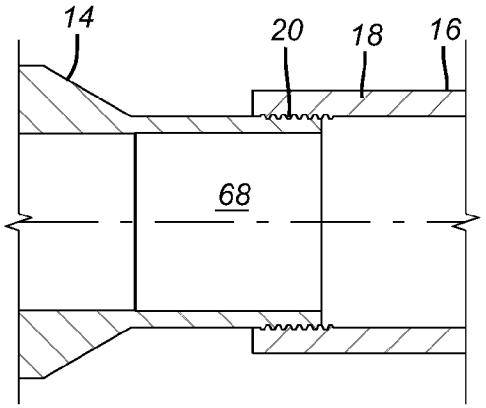
Figure 2D:
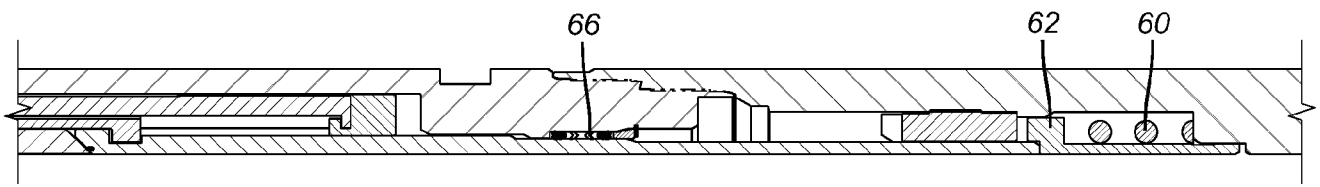
Figure 2E:
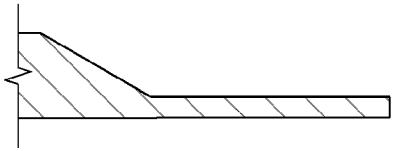
Figure 3A:
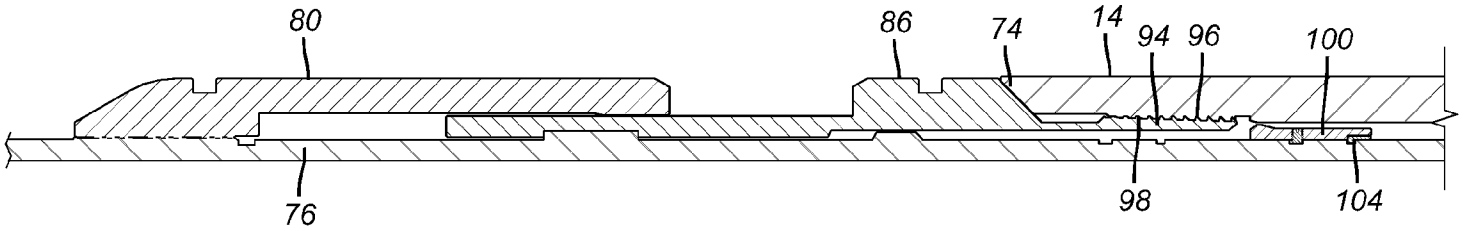
FIGS. 3*a*-3*d* are the view of FIGS. 2*a*-2*e* showing the valve actuation sleeve shifted and just being released.

Referring again to FIGS. 1*a* and 1*b* there is a gap from the shear block 100 to a stack of seals 114 (three are shown but the amount can vary and in fact the seal assembly is optional). In a run in and test mode sealing where the seals 114 are located is not critical. However, if a production string is connected to the RPT 12 when used as a latching tool as will be discussed with FIGS. 7-9 then the seal assembly 114 is not optional. Going further down the mandrel 76 is connected to a coupling 116 and coupling 116 is in turn connected to collet mandrel 118. A mule shoe sleeve 120 having a leading taper 122 is optionally connected to extend beyond the lower end of the collet mandrel 118. Its purpose is to extend into sleeve 44 to centralize the collet mandrel 118 and the collet 124 mounted to the outer surface of collet mandrel 118 that engages or disengages within actuating sleeve 46 of the valve. Collet 124 comprises a plurality of circumferentially spaced fingers with a grip lug 126 and a release lug 128 on each finger. In FIG. 1*b* for run in the grip lug 126 is above the actuating sleeve 46. The release lug is depressed by surface 130 on housing 14. When weight is set down as in FIG. 2*b* the grip lug 126 has advanced and sprung out to internal recess 50 while the release lug 128 has cleared surface 130 to permit such radially outward flexing. Note also that the lower end 132 of the collet mandrel 118 will eventually move adjacent surface 134 just below taper 54 on actuating sleeve 46 when weight is set down, as shown in FIG. 2*c*. The small clearance between 132 and 134 acts as a debris barrier to protect the operation of the collet assemblies 124.

The major components of the RPT 12 having been described, the operation beyond running in and latching anchor 20 into the packer 18 previously discussed in connection with FIG. 1 will now be described. FIGS. 2*a*-2*e* show weight set down on the mandrel 76 which breaks shear screw or screws 88 and allow the mandrel 76 to move down until the shoulder 92 of latch 86 hits travel stop 90 on the latch retainer 80. Note also that shear block 100 is still secured to mandrel 76 and has shifted down in recess 136 of housing 14 stopping short of the taper 138. The collet 124 has come down with the collet mandrel 118 so that the release lug 128 has gone past surface 130 that had been holding it radially retracted to allow the grip lug 126 which has also shifted down to snap radially out into recess 50 in actuating sleeve 46 at a location below the stop 52. The lower end 132 of the collet mandrel 118 is now juxtaposed against surface 134 of the actuating sleeve 46 to act as a debris barrier that protects the collet assembly 124 that is supported by the collet mandrel 118. For a valve 10 that is closed, the beveled surface 53 at the end of the collet mandrel 118 pushes on the actuating sleeve 46 at a mating beveled surface 51 to shift the valve into an open position. The collet assembly 124 then remains engaged to the actuating sleeve 46 and is ready to move it when the mandrel 76 is picked up. At this time in FIG. 2 the latch fingers 94 have their exterior square thread 96 in mating contact with threads 98 on housing 14 but the shear block 100 is still spaced apart so that it cannot lend support to the fingers 94 to force them against the housing 14. Again the movement in FIG. 2 is setting down weight when the housing 14 is supported on the anchor 20 and the packer 18 so there is no risk of separation between latch 86 and the housing 14. During run in shown in FIG. 1 the weight of the housing 14 pushed the fingers 94 into contact with housing 14 as the fingers 94 with the weight hanging on them were pushed into and cammed out by the shear block 100 that was still secured to mandrel 76 by the shear ring 104.

FIG. 3 depicts what happens as a pulling force is applied from the FIG. 2 position. The mandrel 76 and the latch retainer 80 have moved up in tandem, as seen in FIG. 3*a*. The latch 86 has remained on top 74 of the housing 14 because the collet fingers 94 have their exterior square thread 96 still engaged to the mating square thread 98 on the housing 14. The shear block 100 has now moved closer to the collet fingers 94 but has not yet come into contact with them because tandem movement with mandrel 76 is depicting the lug 126 of the collet 124 at moment of release from the actuating sleeve 46 as it contacts the travel stop 56. As shown in FIG. 3*b* the actuating sleeve 46 has been picked up to the travel stop 56 on the housing 14. That pickup movement has rotated the ball 22 to the closed position. The ball 22 had been open for running in and setting down weight steps of FIGS. 1 and 2. The actuating sleeve 46 was shifted by virtue of grip lug 126 being in groove 50 inside the actuating sleeve 46. As the grip lug 126 approached the travel stop 56 the release lug 128 hit surface 130 on the housing 14 which had the effect of pushing the collet 124 radially inwardly so that the grip lug 126 timely retracted from groove 50 just as the actuating sleeve 46 hit its travel stop at 56. Note also that lug 58 on the exterior of the actuating sleeve 46 has now landed in groove 57 of the housing 14 so that the position of the actuating sleeve 46 with the ball 22 closed is now firmly held in position. With further pulling as will be discussed in FIG. 4 the collet 124 will fully release from the actuating sleeve 46 while the RPT 12 is still connected to the housing 14.

In FIG. 4 there has been further upward movement of the mandrel 76 from its FIG. 3 position. At this time the shear block 100 is in position under the collet fingers 94 to drive them radially outward into housing 14 in preparation for the later shearing of the shear ring 104, which at this time is still intact. Note also that the grip lug 126 has moved up past the end of the internal groove 50 of the actuating sleeve 46 and the release lug 128 is a bit further along into reduced diameter surface 130 and the ball 22 of the valve 10 remains in a closed position. At this time pressure can be applied through the RPT 12 to test the ball 22 in the closed position to determine if it holds pressure. Alternatively if the seal assembly 114 is omitted since it is optional for this configuration of the RPT 12 then the annulus around the RPT 12 can be pressurized and both the ball 22 that is now closed as well as the seal of the set packer 18 can be tested together. At this time there is no way to damage the actuating sleeve 46 or rods 42 or the slide assembly 40 or the ball 22 when the shear ring 104 is later sheared with a pulling force because the collet 124 has previously released from the interconnected components of the valve 10.

FIG. 5 differs from FIG. 4 in that the pressure holding test on ball 22 has been completed and further pulling has sheared the shear ring 104 to allow the shear block 100 to fall onto the seal assembly 114 so that the collet fingers 94 can flex radially inwardly so that their exterior square thread can detach from mating thread 98 and the RPT 12 can be pulled clear of the housing 14. In doing so the external lug 108 comes into contact with the upper shoulder 107 to forcefully release the now unsupported latch 86 from the housing 14.

In FIG. 6 the RPT 12 is the same tool as in FIG. 1 except that now valve 10 is already at a location downhole and the RPT 12 is being run in on a workstring to latch into and then pull the valve 10. FIG. 6 depicts the RPT 12 already latched into the valve 10 for pulling it. In this pulling configuration, the shear block 100' is initially mounted higher on the mandrel 76 so that when run in and then latched it is already in contact with the collet fingers 94 to support them into gripping contact of threads 96 and 98 to the housing 14. The grooves 200 and 202 that had been used in FIG. 1 for the shear screw or screws 102 and the shear ring 104 respectively are now unused. The shear ring 104' is also sized to release at a far higher value than a shear release at anchor 20 adjacent the packer 18. In this configuration there is no relative movement between the mandrel 76 and the housing 14 when a pulling force is applied to the mandrel 76. Thus despite the location of the lifting lug 126 in internal groove 50 below the travel stop 54 of the actuating sleeve 46 this sleeve will not shift when the RPT 12 is moved up because housing 14 of the valve 10 will come out of the packer 18 as the mandrel 76 is picked up. Note however when this configuration of the tool is landed in the housing 14 and the ball 22 is in the closed position the lifting lug 126 will first push down the actuating sleeve 46 so that ball 22 opens followed by lug 126 jumping into groove 50. Once again the engagement of anchor 20 at the packer 18 has left hand thread to allow an alternate way to release from the packer 18 by rotating to the right instead of applying a pickup force to the mandrel 76. This is because the thread pair 96 and 98 is a right hand thread which will simply get tighter by turning to the right and because the mandrel 76 is rotationally locked to the latch 86 by the interaction of fin or fins 110 in groove or grooves 112. Ball 22 was open and remains open after the housing 14 and anchor 20 releases from the packer 18 so that the string supporting mandrel 76 is not pulled "wet" or full of fluid that cannot drain out.

In FIGS. 7-9 the production shifting tool (PST) 12' is modified so that it operates as a latching tool with a production string that has the capability to operate the ball 22 when pulled out but it lacks the capability to remove the housing 14 as the shear block 100 is eliminated. In short when this configuration is secured to the lower end of a production string (not shown) it enters the housing 14 of the valve 10 that is already downhole and mounted to the packer 18 with ball 22 in the closed position. The act of setting down weight makes lug 126' push down the actuating sleeve 46' to facilitate the ball 22 of the valve 10 into an opened position just as or shortly after the collet fingers 94' latch the housing 14 and then jump around it into the internal groove 50'. The seal assembly 114' is mandatory in this configuration to provide a seal between tubing and annulus regions during production of wellbore fluids. With set down weight maintained on this version of the PST 12' production can take place as long as required until it is time for whatever reason to pull the production string. When that happens only the actuating sleeve 46 gets pulled up to close ball 22 as the PST 12' is pulled out of housing 14. There is no ability of the PST 12' to grab the housing 14 because the shear block 100 is eliminated and latch 86 simply disengages from housing 14.

Figure 7A:
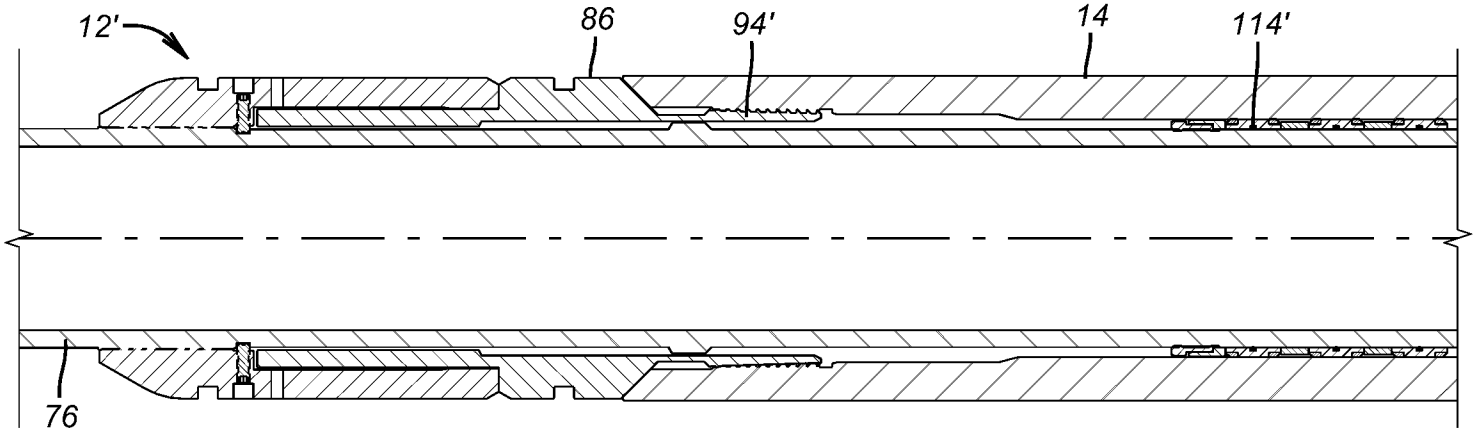
FIGS. 7*a*-7*d* is an alternative configuration of the tool in FIGS. 1*a*-1*d* where there is no ability to transmit torque or to shear release and the tool only latches to the valve housing when run in and weight is set down.
Figure 8A:
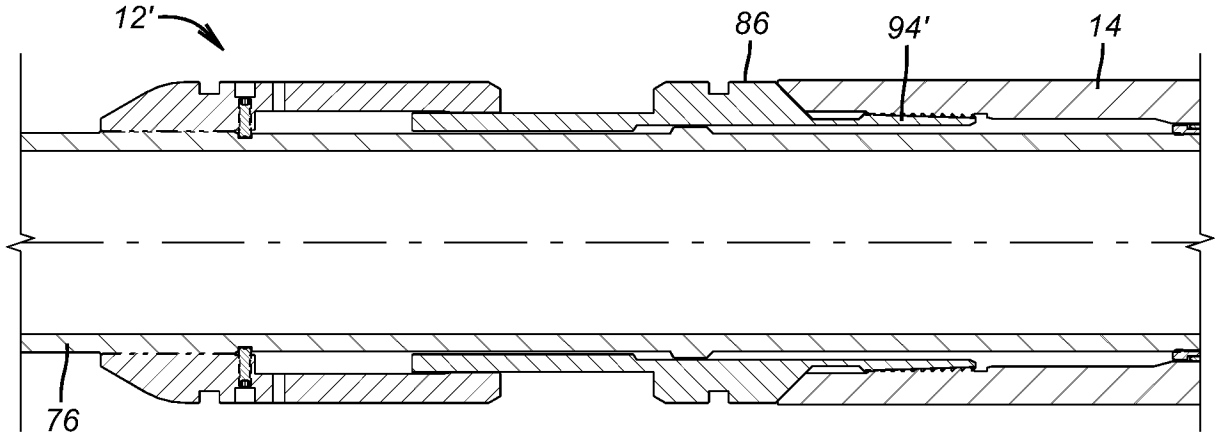
FIGS. 8*a*-8*d* are the tool of FIGS. 7*a*-7*d* showing the valve actuation sleeve shifted and just being released.
Figure 7B:
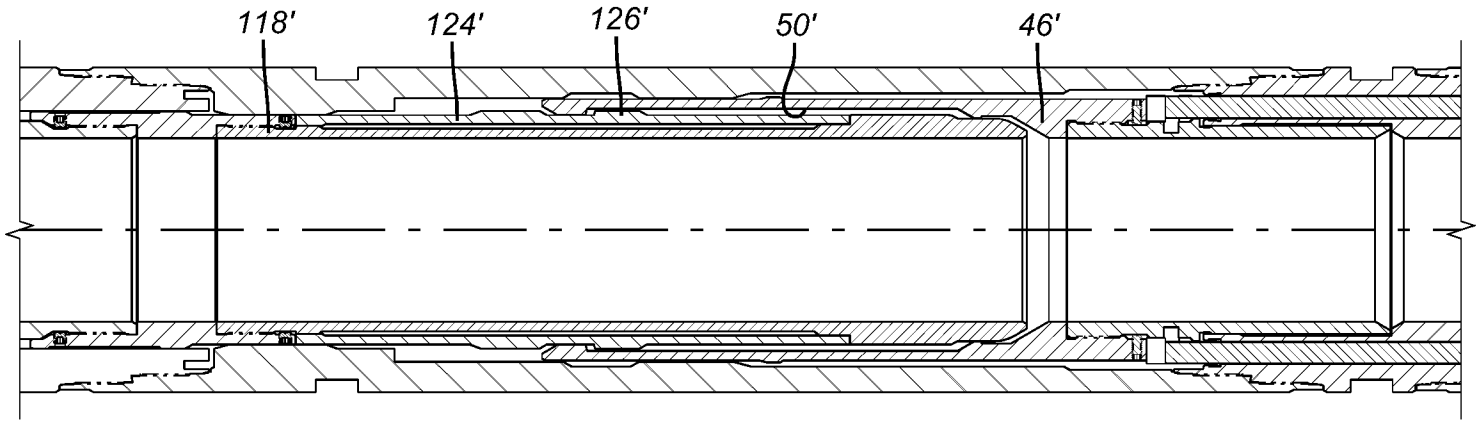
Figure 8B:
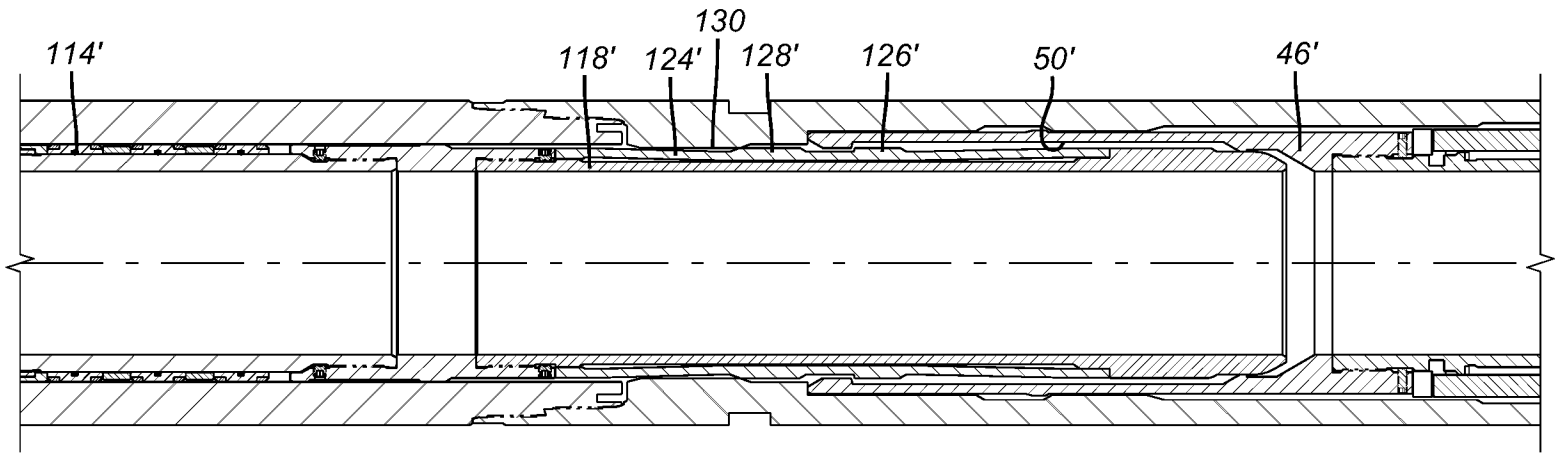
Figure 7C:
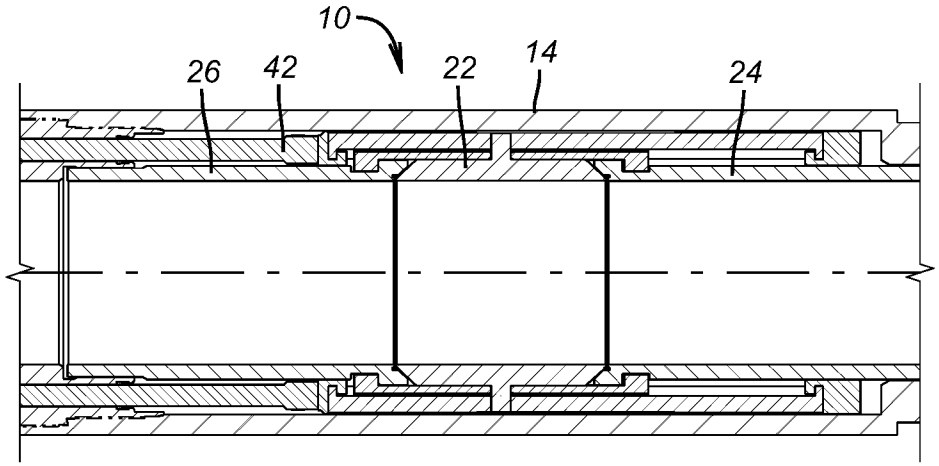
Figure 8C:
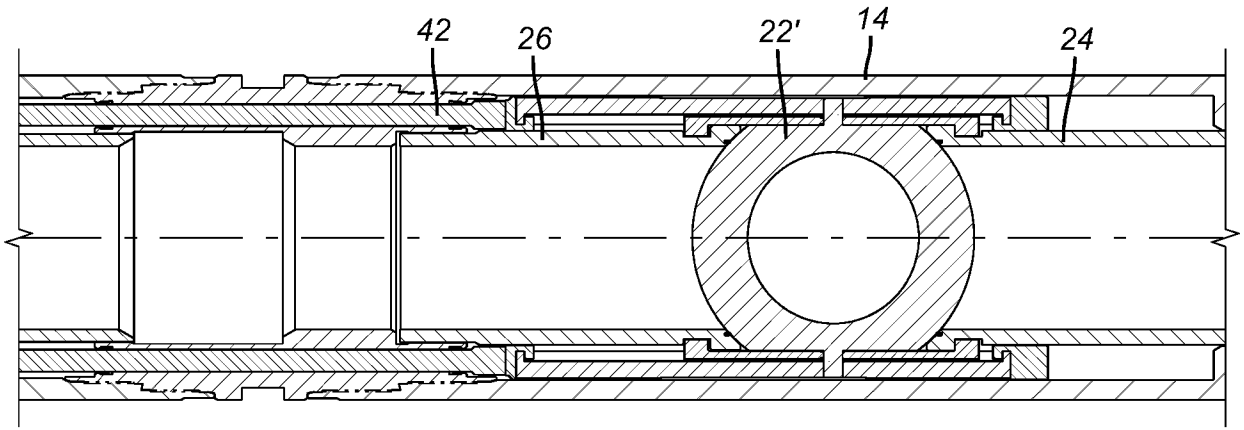
Figure 7D:
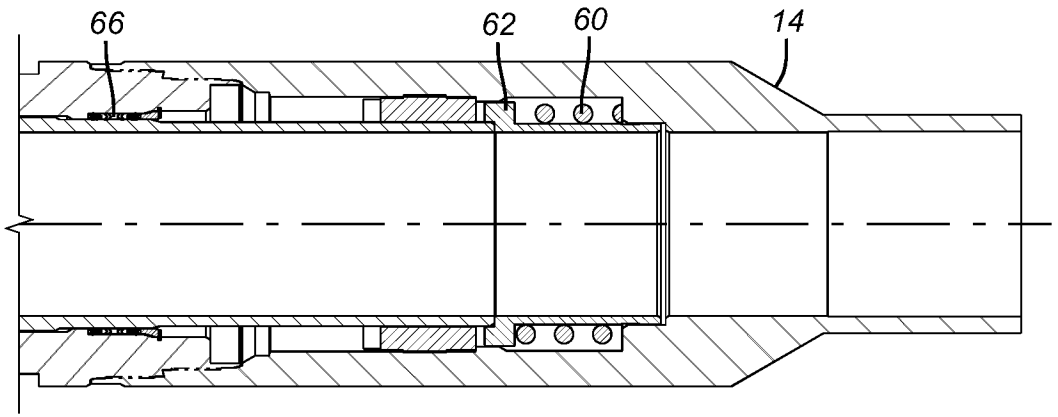
Figure 8D:
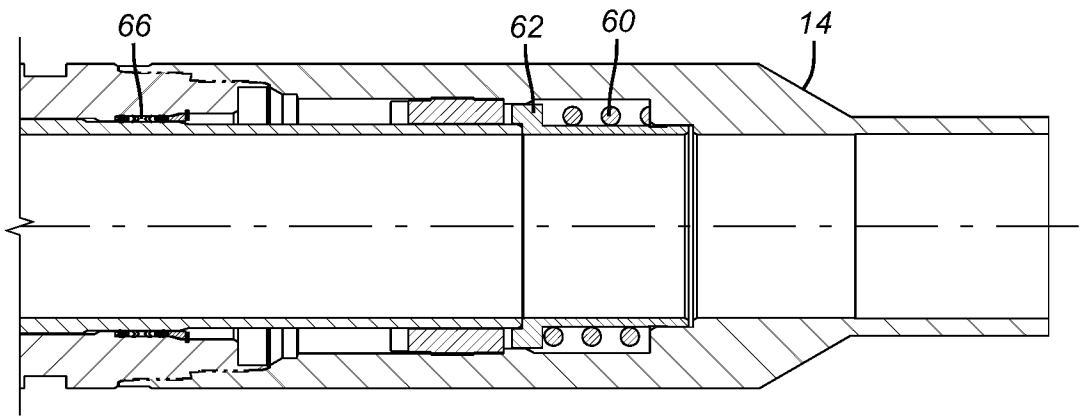
Figure 9A:
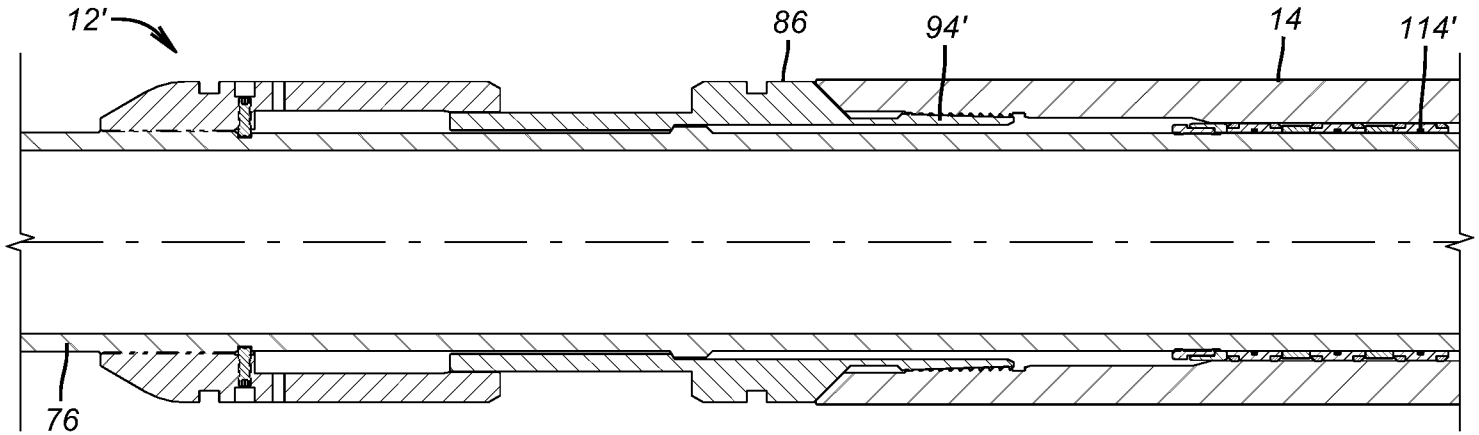
FIGS. 9*a*-9*d* is the view of the tool of FIGS. 8*a*-8*d* showing the tool picked up to engage a shoulder of the threaded latch component before coming unlatched from the valve housing but is momentarily still attached to the valve housing.
Figure 9B:
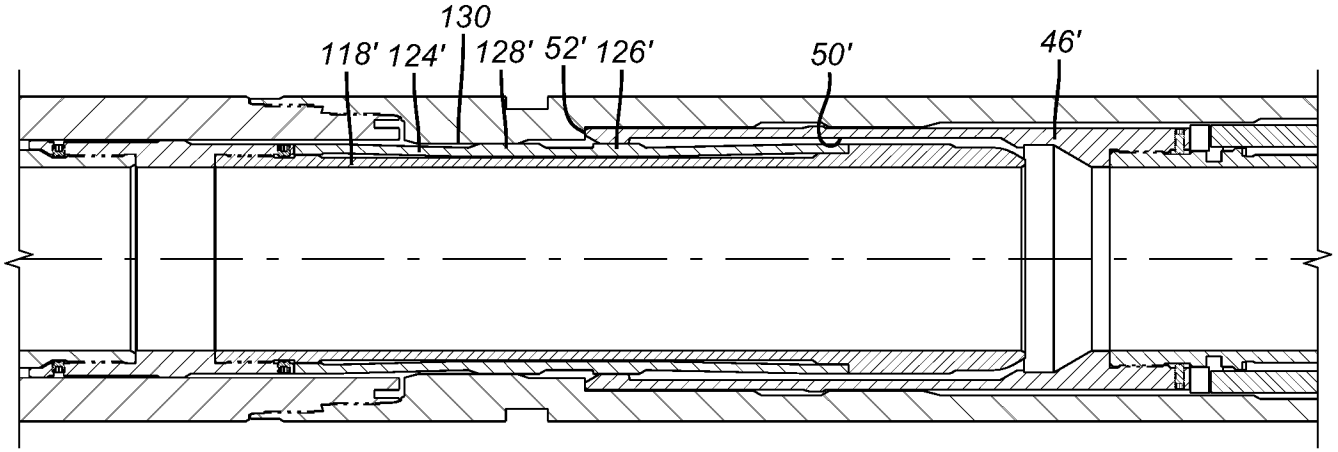
Figure 9C:
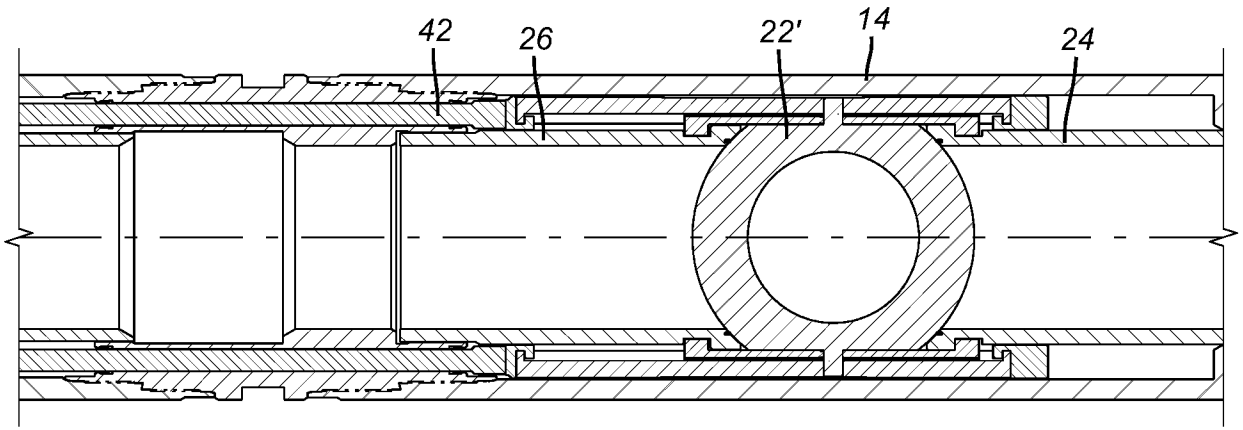
Figure 9D:
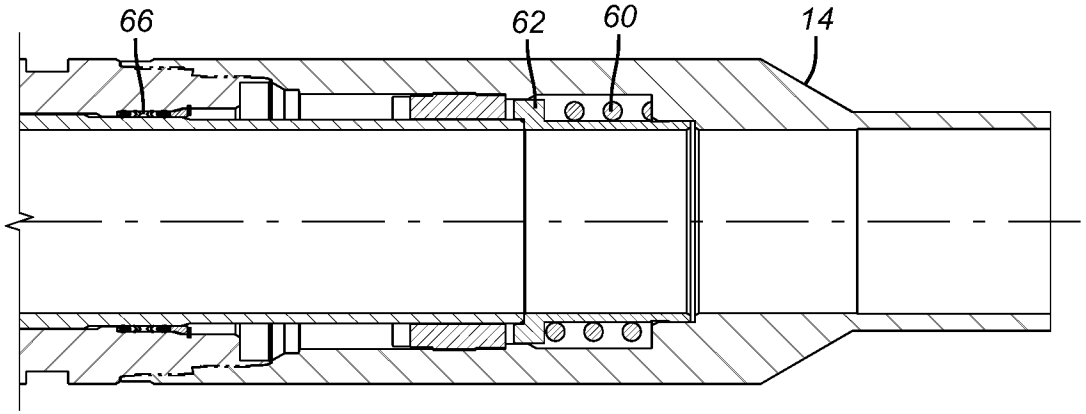

FIG. 7*a* shows the absence of the shear block 100 below the collet fingers 94. This configuration of the tool 12' is really a production shifting tool (PST) as shifting is all it does along with the simple function of latching into or latching out of the housing 14. With weight set down the seal assembly 114' isolates the surrounding annulus from the tubing. The shifting lug 126' is in the groove 50' of the actuating sleeve 46' but will not move the actuating sleeve 46' until the collet mandrel 118' is moved up with respect to the housing 14. In essence the PST 12' just pushes in until it latches and is solid against the housing 14 as shown in FIG. 7*a*. In FIG. 8 the mandrel 76 is picked up and the actuating sleeve 46' is shifted to close the ball 22' of the valve 10. As shown in FIG. 9*b*, by the time the shifting lug 126' reaches the end 52' of slot 50' the retraction lug 128' has engaged surface 130 to force the shifting lug 126' out of groove 50' and the PST 12' is on its way out of the housing 14.

Those skilled in the art will appreciate that the tool can be configured in various ways to accomplish different tasks. In the configuration of FIGS. 1-5 it can run in a tool on a string and latch it downhole followed by operating it at least once and releasing from the operated components while still engaged to the tool housing. This allows pressure testing before release from the tool housing and it separates the ultimate release from the tool housing from operating engagement with actuation components in the downhole tool. In the specific example of FIGS. 1-5 a downhole ball valve is run in and anchored to a packer. Setting down weight operates the actuation sleeve for the valve and opens the ball. A pickup force then moves the valve actuating sleeve in the opposite direction to close the ball and operably release the actuating sleeve by retracting the shifter that had just closed the ball from the actuating sleeve. At this time the tool is still secured to the valve housing, which allows running a pressure test on the closed ball and then applying a large enough force for a shear release from the valve housing by the tool. At the time of the shear release the actuating sleeve of the valve can not any longer be moved by the tool. What can happen with large pulling forces on long strings is a sudden dynamic motion as the shearing occurs. With the actuating sleeve effectively released before the shear release from the valve housing occurs there is no risk of damage to the ball operating components as there was in the past when the actuation of the tool and the shear release were a single fluid motion. In those past instances parts of the ball actuation assembly were at risk of being sheared or bent or otherwise damaged as significant dynamic motions and forces were transmitted to such parts during the shear release.

In the FIG. 6 embodiment, the shear ring in the tool is placed at a different location and has a higher release value than a release below the tool housing such as in an anchor set in a packer when the tool is a ball valve that is latched into it. In this configuration latching into the ball valve will open it and pulling up will release the valve housing from the packer below. The valve can now be pulled with the string that latched into the top of it when in the open position so that a "wet string" is not pulled.

In the FIGS. 7-9 the tool is run on the bottom of a production sting and landing on the valve simply opens it so production can commence. Lifting the tool simply closes the valve and the production string and the tool can come out. As long as a set down force is maintained production can continue. Note in this version a seal against the annulus is mandatory so that production can continue up the string to the surface while avoiding the annulus. There is no ability with this embodiment to pull the valve housing, only to tag into it for production and then pull out of the hole. For that reason the collet support ring and its associated shear ring are omitted.

While the preferred embodiment is described as a ball valve other types of tools are contemplated. Among valve tools a sliding sleeve can be operated with the various configurations of the tool illustrated in the FIGS.

The above description is illustrative of the preferred embodiment and many modifications may be made by those skilled in the art without departing from the invention whose scope is to be determined from the literal and equivalent scope of the claims below.

We claim:

1. An operating tool for a subterranean tool located in or delivered to a tubular string and actuated by movement of a movable member in a housing in the subterranean tool by the operating tool, comprising:

a mandrel having an open passage therethrough delivered on a string to the subterranean location, said mandrel supporting a selectively releasable gripping member to selectively actuate the movable member of the subterranean tool in opposed directions while selectively fixedly and sealingly engaged to the housing of the subterranean tool with a latch said actuation facilitating pressure testing the string through said mandrel open passage and to the housing of the subterranean tool with said subterranean tool in a closed position;

said gripping member releasing from the movable member before said latch mechanically releases from the housing in response to a mechanical force applied to the string.

2. The tool of claim 1, wherein:

said gripping member releasing from the movable member before a force can be transmitted from said mandrel to said latch.

3. The tool of claim 2, wherein:

said gripping member moves relatively to said latch.

4. The tool of claim 3, wherein:

said gripping member moves in tandem with said mandrel.

5. The tool of claim 4, wherein:

said gripping member comprises at least one radially protruding member with respect to said mandrel.

6. The tool of claim 5, wherein:

said radially protruding member comprises a grip lug and a retraction lug spaced apart from each other.

7. The tool of claim 6, wherein:

said grip lug on initial relative movement with respect to said latch initially engages the movable member at a first location to move the movable member in a first direction.

8. The tool of claim 4, wherein:

said mandrel moves axially relative to said latch and is rotationally locked to said latch;

said mandrel has a removal lug to engage said latch upon a predetermined relative movement by said mandrel.

9. The tool of claim 5, wherein:

said mandrel further comprises a muleshoe extending from a lower end to enter the movable member for centering said flexible member and for creating a surrounding clearance around said mandrel to reduce debris access to said flexible member.

10. The tool of claim 1, wherein:

the movable member operates a barrier tool.

11. The tool of claim 10, wherein:

said barrier tool comprises a ball valve or a sliding sleeve.

12. The tool of claim 1, wherein:

said mandrel comprising a sealing assembly that engages the housing.

13. An operating tool for a subterranean tool actuated by movement of a movable member in a housing in the subterranean tool by the operating tool, comprising:

a mandrel supporting a selectively releasable gripping member to selectively actuate the movable member of the subterranean tool while selectively fixedly engaged to the housing of the subterranean tool with a latch;

said gripping member releasing from the movable member before said latch releases from the housing;

said gripping member releasing from the movable member before a force can be transmitted from said mandrel to said latch;

said gripping member moves relatively to said latch;

said gripping member moves in tandem with said mandrel;

said gripping member comprises at least one radially protruding member with respect to said mandrel;

said radially protruding member comprises a grip lug and a retraction lug spaced apart from each other;

said grip lug on initial relative movement with respect to said latch initially engages the movable member at a first location to move the movable member in a first direction;

said grip lug moving past the movable member after moving the movable member in said first direction to engage the movable member in a second location for movement in a second direction opposite said first direction to actuate said subterranean tool.

14. The tool of claim 13, wherein:

after a predetermined movement of said grip lug while retaining the movable member in a second direction said retraction lug is engaged to push said grip lug away from the movable member.

15. The tool of claim 14, wherein:

said latch comprises at least one collet to engage the housing and a support member releasably mounted to said mandrel;

said support member moving toward said collet when said grip lug moves in said second direction.

16. The tool of claim 15, wherein:

said grip lug is moved by said retraction lug away from the movable member before said support member engages said collet.

17. The tool of claim 16, wherein:

said support member is retained to said mandrel with a shearable member for selective release from the housing of the subterranean tool;

said collet comprises an external thread pattern to engage a similar thread pattern on the housing for gripping the housing when said support member engages said collet.

18. The tool of claim 17, wherein:

said mandrel allowing said support member to be mounted in two locations;

in a lower location for said support member, movement of said grip lug in said second direction shifts the movable member and in an upper location for said support member on said mandrel movement of said grip lug in said second direction does not shift the movable member.

19. The tool of claim 18, wherein:

said shearable member when set in said lower location is selected to fail at a value that allows said mandrel to release from the housing;

said shearable member when set in said upper location is selected to fail at a value that fails at a higher level than when in said lower location with the result that said mandrel removes the housing when moved in said second direction.

20. The tool of claim 19, wherein:

said subterranean tool is a barrier tool that is closed when said mandrel releases from the housing but which remains open if said mandrel removes said housing.

21. The tool of claim 14, wherein:

said latch remains fixedly engaged to the housing only with set down weight applied to said mandrel.

22. The tool of claim 21, wherein:

said latch comprises at least one collet to engage the housing;

said collet comprises an external thread pattern to engage a similar thread pattern on the housing for gripping the housing only when weight is set down on said mandrel.

* * * * *